US008677884B2

(12) United States Patent
Ogasawara et al.

(10) Patent No.: US 8,677,884 B2
(45) Date of Patent: Mar. 25, 2014

(54) HYDRAULIC PUMP/MOTOR AND FAN DRIVING DEVICE

(75) Inventors: Kenichi Ogasawara, Oyama (JP); Kazuhiro Maruta, Kawaguchi (JP); Mutsumi Ono, Oyama (JP)

(73) Assignee: Komatsu Ltd., Tokyo (JP)

( * ) Notice: Subject to any disclaimer, the term of this patent is extended or adjusted under 35 U.S.C. 154(b) by 877 days.

(21) Appl. No.: 12/735,469

(22) PCT Filed: Dec. 22, 2008

(86) PCT No.: PCT/JP2008/073287

§ 371 (c)(1),
(2), (4) Date: Jul. 20, 2010

(87) PCT Pub. No.: WO2009/096118

PCT Pub. Date: Aug. 6, 2009

(65) Prior Publication Data

US 2010/0287926 A1 Nov. 18, 2010

(30) Foreign Application Priority Data

Jan. 28, 2008 (JP) ..... 2008-016739

(51) Int. Cl.
*F03C 1/253* (2006.01)
*F04B 1/22* (2006.01)

(52) U.S. Cl.
USPC ..... 91/1; 92/5 R

(58) Field of Classification Search
USPC ..... 91/1; 92/5 R, 71; 60/487
See application file for complete search history.

(56) References Cited

U.S. PATENT DOCUMENTS

| | | | | |
|---|---|---|---|---|
| 6,547,531 | B1 | 4/2003 | Cumbo et al. | |
| 2005/0172621 | A1 * | 8/2005 | Kadlicko | 60/413 |
| 2005/0172798 | A1 | 8/2005 | Kadlicko | |
| 2005/0172799 | A1 | 8/2005 | Kadlicko | |
| 2005/0175442 | A1 | 8/2005 | Kadlicko | |
| 2005/0175471 | A1 | 8/2005 | Kadlicko | |
| 2007/0028608 | A1 | 2/2007 | Kadlicko | |

FOREIGN PATENT DOCUMENTS

| | | | | |
|---|---|---|---|---|
| JP | 04-058070 | A | | 2/1992 |
| JP | 06-002647 | A | | 1/1994 |
| JP | 06002647 | A | * | 1/1994 |
| JP | 2002-267679 | A | | 9/2002 |
| JP | 2003-035297 | A | | 2/2003 |
| JP | 2003035297 | A | * | 2/2003 |
| JP | 2003-232278 | A | | 8/2003 |
| JP | 2007-522387 | | | 8/2007 |

OTHER PUBLICATIONS

International Search Report dated Mar. 24, 2009, issued on PCT/JP2008/073287.

* cited by examiner

*Primary Examiner* — Thomas E Lazo
(74) *Attorney, Agent, or Firm* — Edwards Wildman Palmer LLP

(57) ABSTRACT

A hydraulic motor 10 of the invention includes a detected unit 52 formed on an outer circumferential surface of a cylinder block 14 and a rotation sensor 50arranged opposed to the detected unit 52 for detecting the detected unit 52. The rotation sensor 50 is provided on a position corresponding to a position between a deepest portion 41 of a cylinder hole 29 and a rear end face 28 of the cylinder block in an axial direction of the cylinder block. A fan driving device 60 is provided with the hydraulic motor 10, a bracket 61 to which the hydraulic motor is attached in a state in which a tip end of the rotational shaft 13 is arranged on a surface side thereof through a through-hole 64 and a fan 62 attached to the rotational shaft 13 and is driven by the hydraulic motor.

5 Claims, 7 Drawing Sheets

HYDRAULIC PUMP/MOTOR AND FAN DRIVING DEVICE

TECHNICAL FIELD

The invention relates to a hydraulic pump/motor provided with a rotation sensor and a fan driving device.

BACKGROUND ART

Conventionally, a hydraulic pump driven by an engine and a hydraulic motor driven by oil are often used in a construction machine and the like.

For example, an axial swash plate hydraulic pump/motor is provided with a rotational shaft rotatably attached in a casing, a cylinder block rotating together with the rotational shaft, a plurality of pistons fittedly inserted into a plurality of cylinder holes formed on the cylinder block so as to be able to reciprocate, a swash plate provided in the casing so as to be tilted relative to the rotational shaft for supporting tip ends of the pistons so as to be able to slidingly contact, and a valve plate slidingly contacting a rear end face of the cylinder block, and is configured to distribute oil in the cylinder holes through a port provided on the valve plate.

When using the swash plate hydraulic pump/motor as the hydraulic pump, the cylinder block is rotated by rotate-driving the rotational shaft by the engine and the like and the piston is allowed to reciprocate, thereby pressurizing the oil sucked from a low-pressure side port to the cylinder hole by the piston to discharge from a high-pressure side port.

Also, when using the swash plate hydraulic pump/motor as the hydraulic motor, the oil is supplied from the high-pressure side port to the cylinder hole and the piston is protruded from the cylinder hole to press the swash plate, thereby rotating the rotational shaft together with the cylinder block.

As such swash plate hydraulic pump/motor, the one provided with a rotation sensor for detecting a rotational speed of the cylinder block is known (refer to the Patent Document 1). FIG. 7 is a cross-sectional view illustrating a schematic configuration of the swash plate hydraulic pump/motor disclosed in the patent document 1. A swash plate hydraulic pump/motor 100 is provided with a casing 110, a lid body 120, a rotational shaft 130, a cylinder block 140, a piston 150, a valve plate 160 and a swash plate 170. Detected concave portions 520 are formed on an outer circumferential surface of the cylinder block 140 at predetermined intervals. Electromagnetic pick up rotation sensors 500 for detecting the detected concave portions 520 is arranged on a position opposed to the detected concave portions 520 and is fixed to the casing 110. When the cylinder block 140 rotates, each detected concave portion 520 passes through the position of the rotation sensor 500, thereby periodically changing distance (magnetic field) between the rotation sensor 500 and the detected concave portions 520. The rotation sensor 500 transmits a detection signal corresponding to change in the magnetic field to a controller not illustrated. The controller shapes an alternating-current waveform of the detection signal from the rotation sensor 500 and calculates a frequency thereof as a rotational speed of the cylinder block 140.

Patent Document 1: Japanese Patent Application Laid-Open No. 2002-267679

DISCLOSURE OF INVENTION

Problem to be Solved by the Invention

The above-described swash plate hydraulic pump changes positions of the pistons that slide in the cylinder holes arranged on the same circle by rotating the cylinder block. Also, the swash plate hydraulic motor rotates the cylinder block by change of the positions of the pistons that slide in the cylinder holes with time by supply of high-pressure oil into the cylinder holes arranged on the same circle. Therefore, in both cases of the pump and motor, the rotation of the cylinder block is whirling.

When the swash plate hydraulic pump/motor illustrated in FIG. 7 is driven, the distance between the rotation sensor 500 attached to the casing 110 and the detected concave portions 520 provided on the cylinder block 140 changes by the whirling of the cylinder block 140, so that there is a problem of error in detection of the rotation speed of the cylinder block 140.

The invention is achieved in view of the above circumstances, and an object thereof is to provide the hydraulic pump/motor capable of detecting the rotational speed of the cylinder block with high accuracy regardless of the whirling of the cylinder block.

Means For Solving Problem

Effect Of The Invention

According to an aspect of the present invention, a hydraulic pump/motor includes: a rotational shaft rotatably attached in a casing; a cylinder block rotating together with the rotational shaft; a plurality of pistons fittedly inserted into a plurality of cylinder holes formed on the cylinder block so as to be able to reciprocate; a swash plate provided in the casing so as to be tilted relative to the rotational shaft to allow tip ends of the pistons to slide so as to be able to slidingly contact the swash plate; a valve plate that slidingly contacting a rear end face of the cylinder block, wherein the hydraulic pump/motor distributes oil into the cylinder holes through a port provided on the valve plate; a detected unit formed on an outer circumferential surface of the cylinder block; and a rotation sensor arranged in the casing in a state opposed to the detected unit for detecting the detected unit. The rotation sensor is provided on a position corresponding to a position between a deepest portion of the cylinder hole and the rear end face of the cylinder block in an axial direction of the cylinder block.

Advantageously, in the hydraulic pump/motor, the rotation sensor is arranged in a plane including a line on a sliding surface of the swash plate orthogonal to an axis of the rotational shaft and the axis.

According to another aspect of the present invention, a fan driving device includes: a hydraulic motor including a rotational shaft rotatably attached in a casing in a state in which a tip end of the rotational shaft protrudes from the casing, a cylinder block rotating together with the rotational shaft, a plurality of pistons fittedly inserted into a plurality of cylinder holes formed on the cylinder block so as to be able to reciprocate, a swash plate provided in the casing so as to be tilted relative to the rotational shaft to allow tip ends of the pistons to slide so as to be able to slidingly contact the swash plate, and a valve plate slidingly contacting a rear end face of the cylinder block, the hydraulic motor for distributing oil in the cylinder holes through a port provided on the valve plate; a bracket provided with a planar base portion having a through-hole to which the hydraulic motor is attached in a state in which a tip end of the rotational shaft is arranged on a surface side of the base portion by fittedly inserting the casing into the through-hole; and a fan attached to the tip end of the rotational shaft and is driven by the hydraulic motor. The hydraulic motor includes a plurality of detected units provided on an outer circumferential surface of the cylinder block, and a rotation sensor arranged in the casing in a state opposed to a portion between a deepest portion of the cylinder hole and the rear end face of the cylinder block in an axial direction of the cylinder block for detecting the detected units, and the fan driving device attached to the bracket in a state in which the rotation sensor is located on a rear surface side of the base portion.

Advantageously, in the fun drive device, the hydraulic motor is attached to the bracket in a state in which the rotation sensor is brought closer to a rear surface of the base portion.

Advantageously, in the fun drive device, the rotation sensor is arranged in a plane including a line on a sliding surface of the swash plate orthogonal to an axis of the rotational shaft and the axis.

The hydraulic pump/motor and the fan driving device of the invention are configured such that the detected unit is formed on the outer circumferential surface of the cylinder block and the rotation sensor for detecting the detected unit is provided on the position corresponding to the position between the deepest portion of the cylinder hole and the rear end face of the cylinder block in the axial direction of the cylinder block. Since an arranging position of the rotation sensor is on a base end side of the rotational shaft, this is less affected by the whirling of the cylinder block. Therefore, the distance between the rotation sensor and the detected unit is maintained substantially constant regardless of the whirling of the cylinder block. As a result, the detection accuracy of the rotational speed of the cylinder block may be improved as compared to the conventional one.

Further, the fan driving device of the invention is configured such that the hydraulic motor is attached to the bracket in a state in which the rotation sensor is located on a rear surface side of the bracket. As a result, it is possible to prevent dust and mud entering from outside by the rotation of the fan from attaching to the rotation sensor.

EXPLANATIONS OF LETTERS OR NUMERALS

Figure 1:
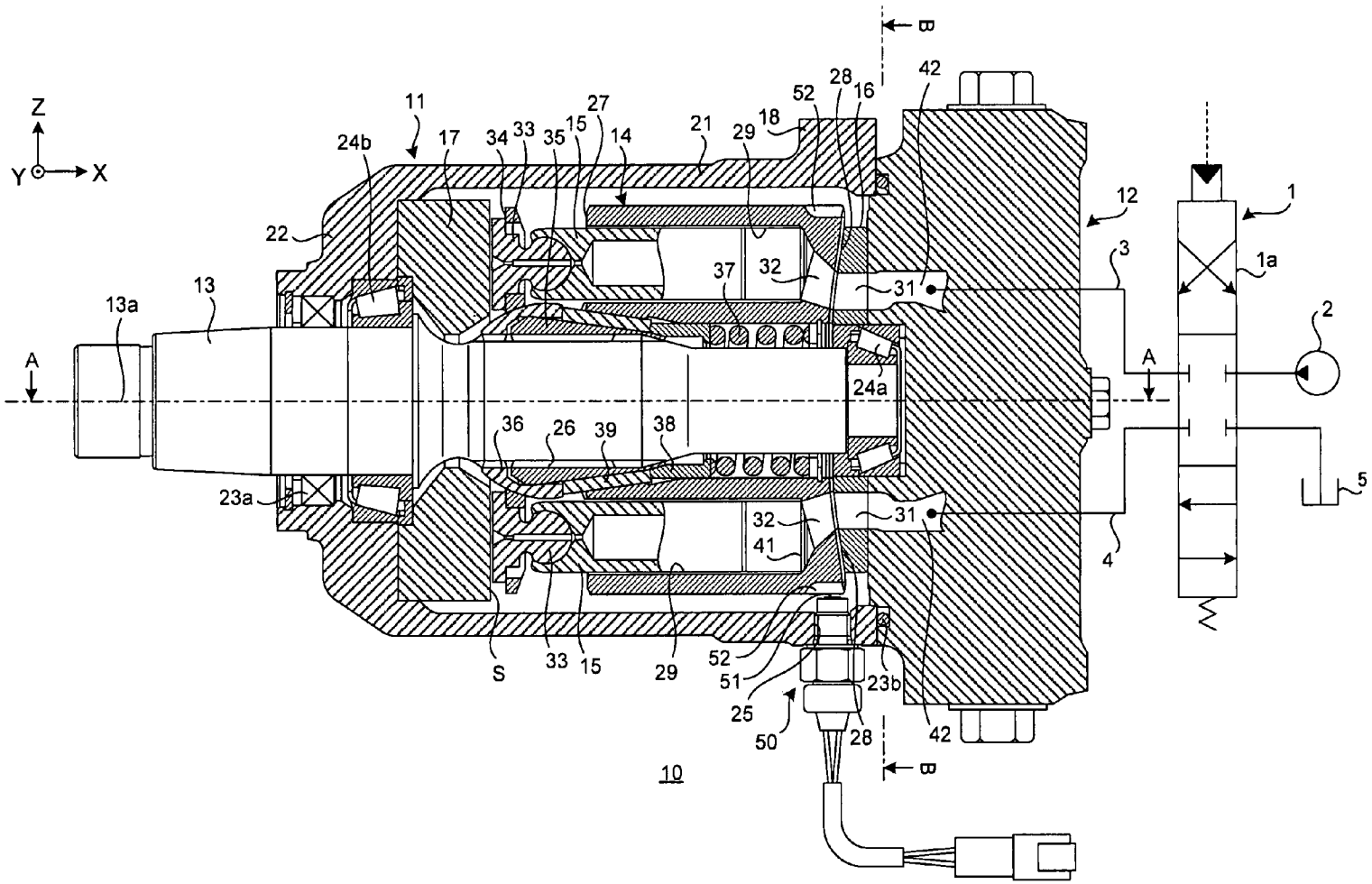
FIG. 1 is a cross-sectional view illustrating a schematic configuration of a hydraulic motor applied to a fan driving device being this embodiment.

1 direction switching valve
2 hydraulic pump
3, 4 pipe lines
5 oil tank
10 swash plate hydraulic motor
11 casing
12 end cover
13 rotational shaft
13*a* axis
14 cylinder block
15 piston
16 valve plate
17 swash plate
18 attaching portion
21 cylindrical portion
22 end wall portion
23 oil seal
24*a*, 24*b* bearing
25 through-hole
26 spline
27 tip end side end face
28 rear end side end face
29 cylinder hole
31 supply/discharge port
32 cylinder port
33 piston shoe
34 shoe retainer
35 convex portion (of cylinder block)
36 retainer guide
37 spring
38 sheet
39 pin
41 cylinder hole deepest portion
42 supply/discharge passage
50 rotation sensor
51 detecting unit
52 detected unit
53 concave portion
54 convex portion
60 fan driving device
61 bracket
62 fan
63 shroud
64 through-hole
65 base portion
66 side wall portion
67 fan boss
68 blade
69 opening
71, 72 bolt
80 radiator

BEST MODE(S) FOR CARRYING OUT THE INVENTION

A preferred embodiment of a hydraulic pump/motor and a fan driving device of the invention is hereinafter described in detail with reference to the attached drawings. Meanwhile, in the following embodiment, an example in which the hydraulic pump/motor of the invention is applied to a swash plate hydraulic motor and the swash plate hydraulic motor is applied to the fan driving device is described.

Figure 2:
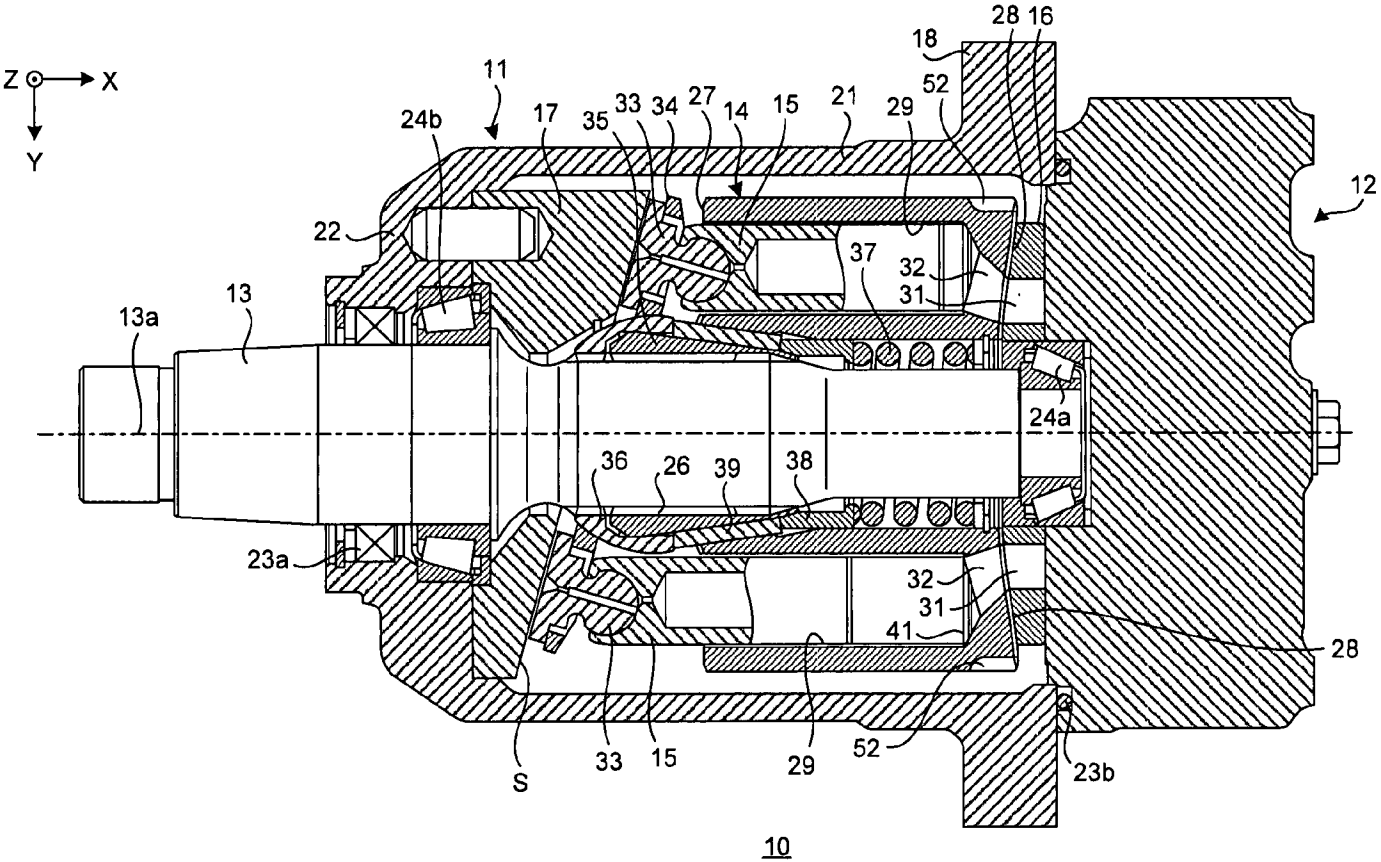
FIG. 2 is a cross-sectional view taken along the line A-A of the hydraulic motor illustrated in FIG. 1.
Figure 3:
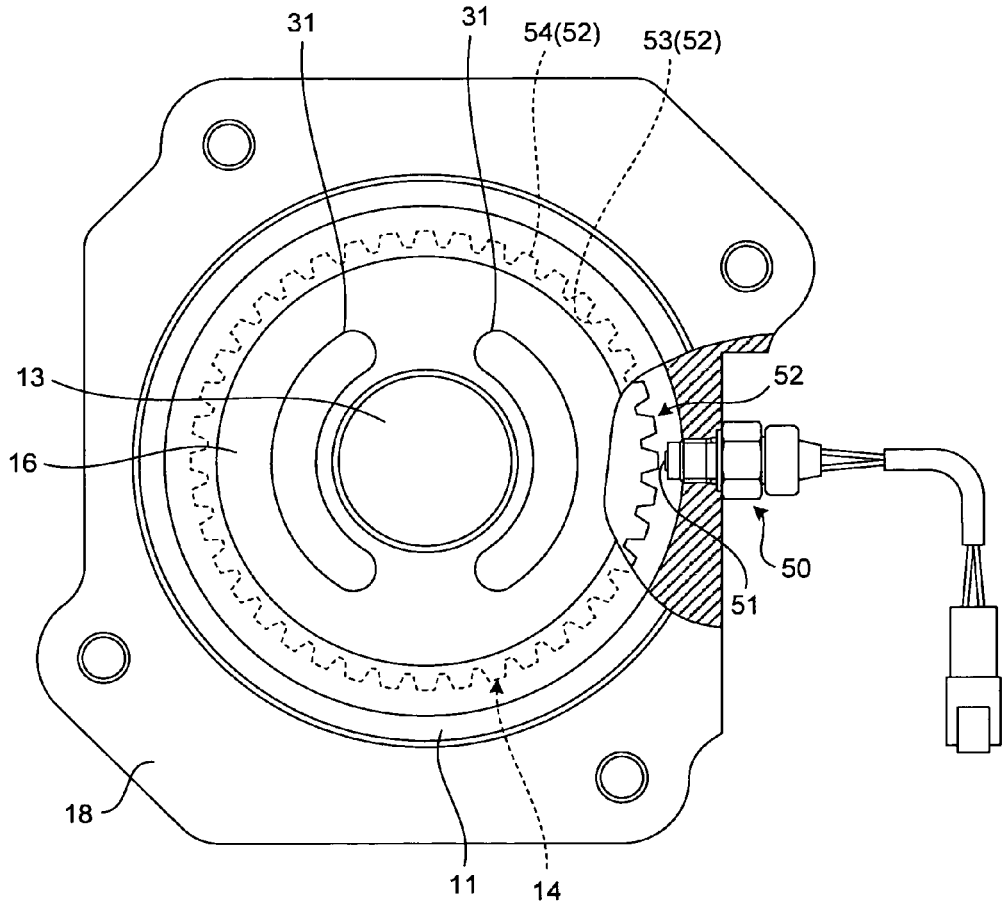
FIG. 3 is a cross-sectional view taken along the line B-B of the hydraulic motor illustrated in FIG. 1.

FIG. 1 is a cross-sectional view illustrating a schematic configuration of the swash plate hydraulic motor (cross-sectional view in an X-Z plane), FIG. 2 is a cross-sectional view taken along the line A-A of the swash plate hydraulic motor illustrated in FIG. 1 (cross-sectional view in an X-Y plane) and FIG. 3 is a cross-sectional view taken along the line B-B of a swash plate hydraulic motor 10 illustrated in FIG. 1. Also, FIG. 4 is a back view of the fan driving device to which the swash plate hydraulic motor illustrated in FIG. 1 is applied, FIG. 5 is a cross-sectional view taken along the line C-C in FIG. 4 and FIG. 6 is a cross-sectional view taken along the line D-D in FIG. 4.

Figure 4:
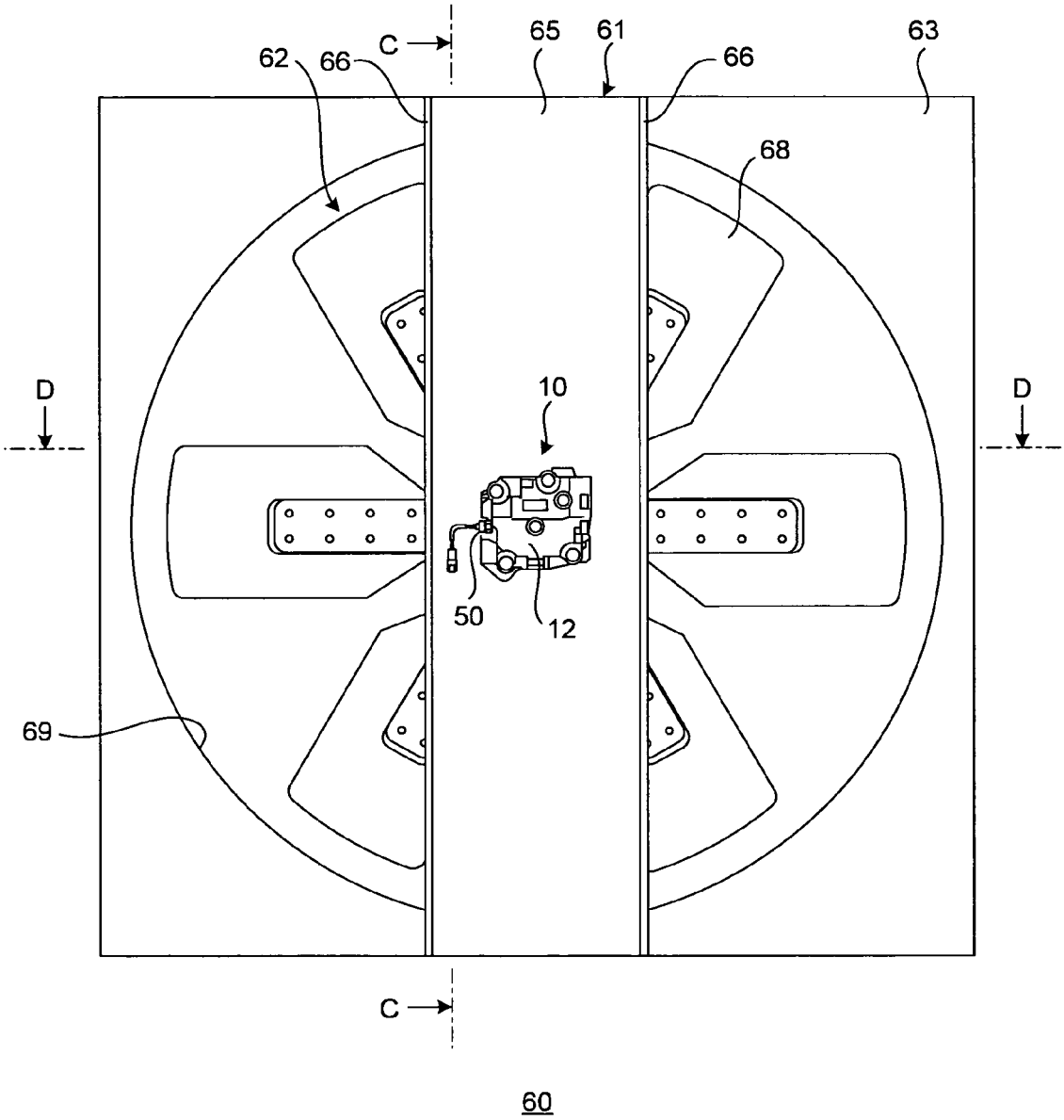
FIG. 4 is a back view of the fan driving device being the embodiment.
Figure 5:
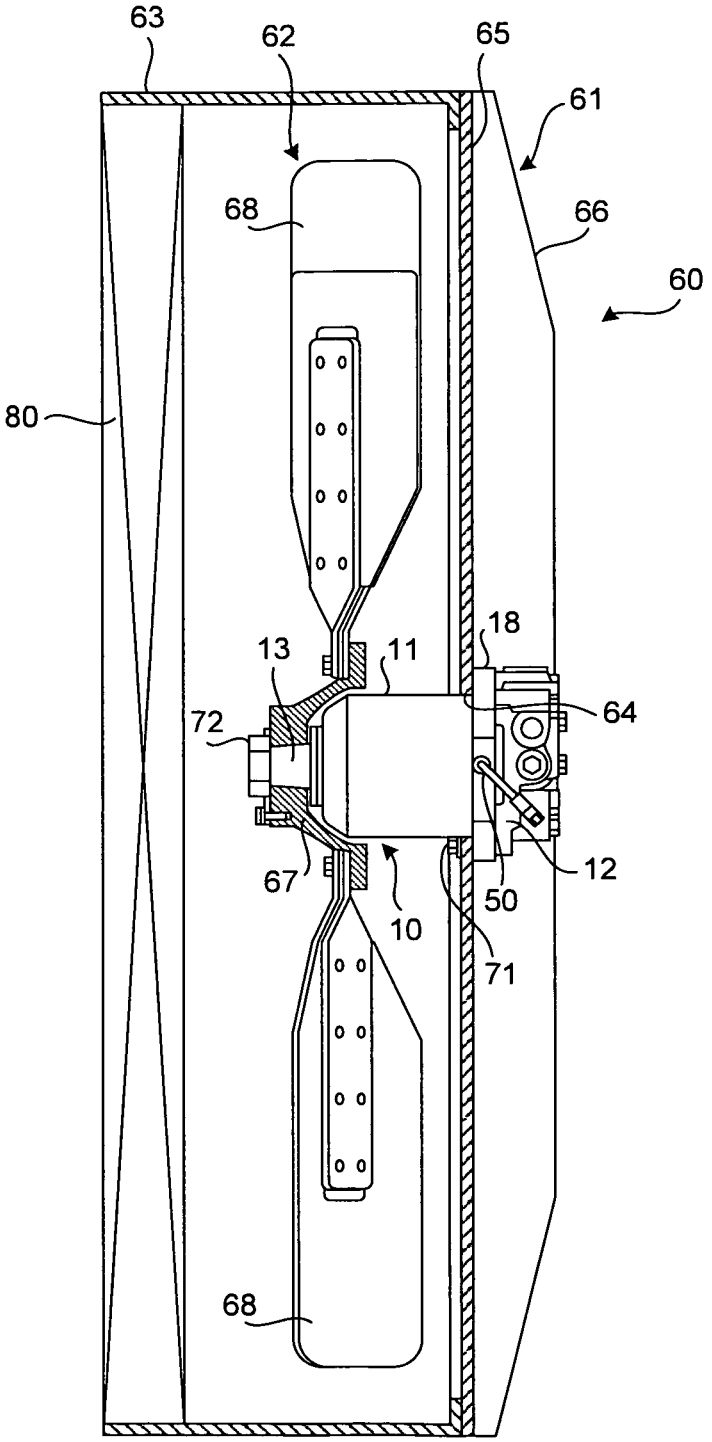
FIG. 5 is a cross-sectional view taken along the line C-C of the fan driving device illustrated in FIG. 4.
Figure 6:
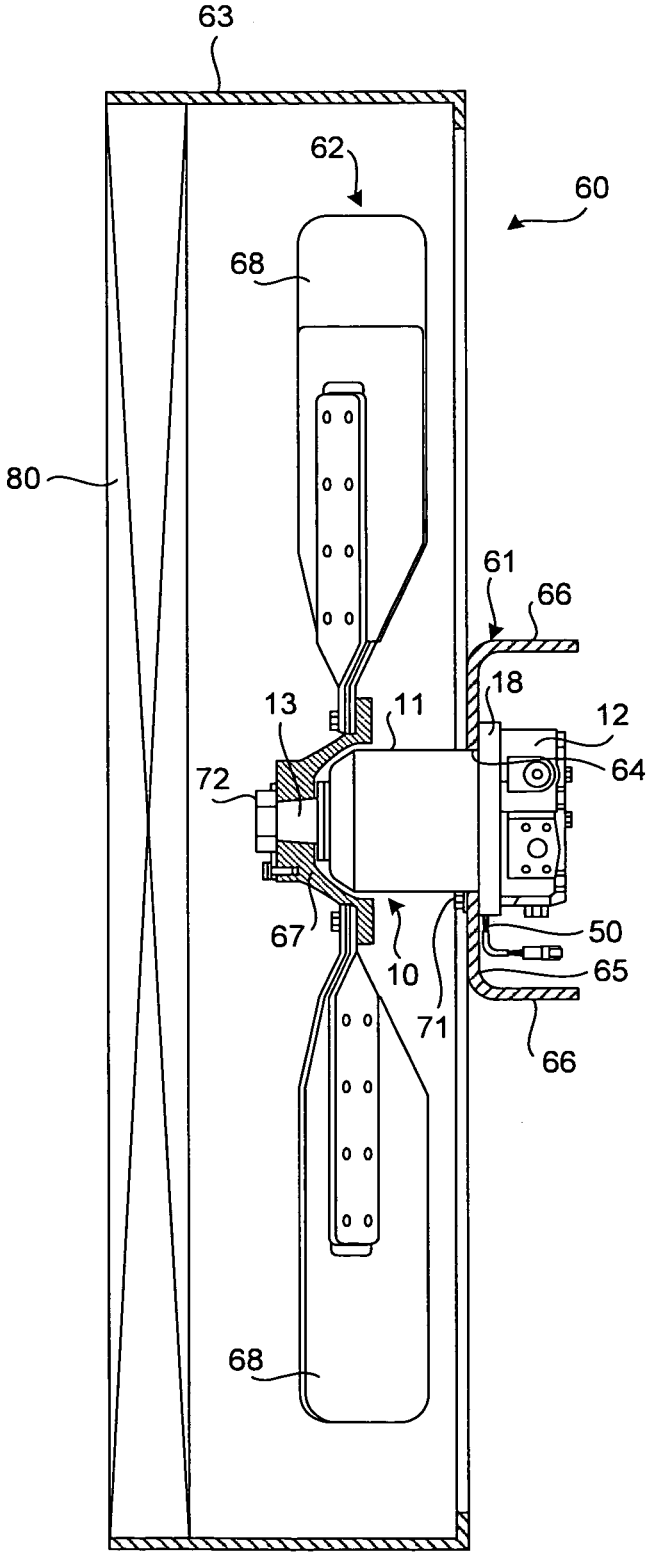
FIG. 6 is a cross-sectional view taken along the line D-D of the fan driving device illustrated in FIG. 4.
Figure 7:
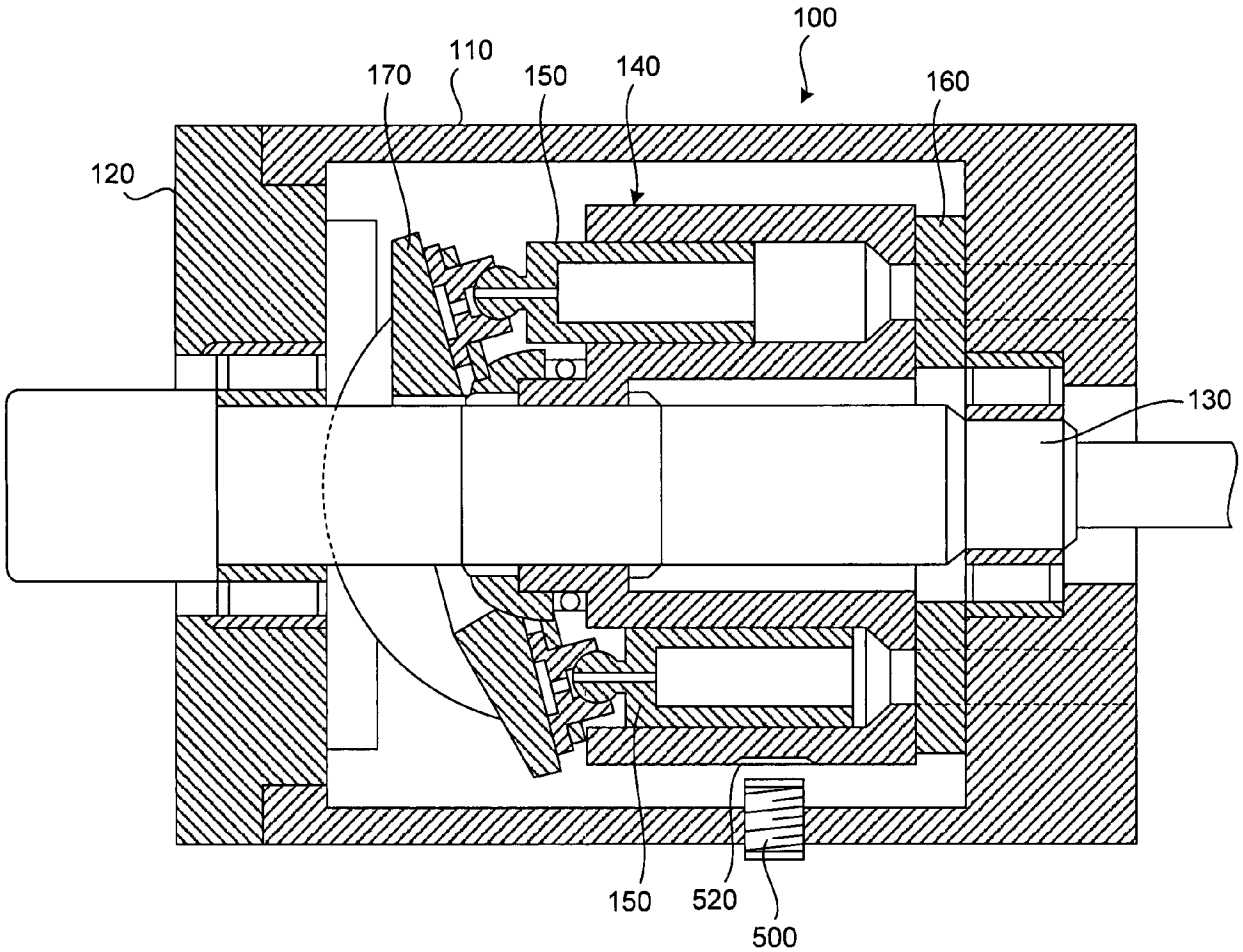
FIG. 7 is a cross-sectional view illustrating a schematic configuration of a conventional hydraulic pump/motor.

A fan driving device 60 illustrated in FIGS. 4 to 6 is a device that drives a fan for cooling a radiator 80 of an engine of a constructing machine and the like. The fan driving device 60 is composed of the swash plate hydraulic motor 10 (hereinafter, referred to as a "hydraulic motor" for short), a bracket 61 that supports the hydraulic motor 10, a fan 62 rotatably attached to a rotational shaft of the hydraulic motor 10 to be driven by the hydraulic motor 10 and a shroud 63.

The hydraulic motor 10 converts oil supplied from a hydraulic pump 2 (refer to FIG. 1) to rotational force to rotate the fan 62. As illustrated in FIG. 5, a rotation sensor 50 that detects a rotational speed of the fan 62 is attached to a rear end side of the hydraulic motor 10. The hydraulic motor 10 and the rotation sensor 50 are described later in detail.

The bracket 61 is a plate-like member to which the hydraulic motor 10 is attached. The bracket 61 is composed of a base portion 65 formed into an elongated flat plate shape of which dimension in a longitudinal direction is substantially the same as dimension of the radiator 80, and a side wall portion 66 formed into a flat plate shape bent from both side edges of the base portion 65 backward at a right angle. A through-hole 64 for attaching the hydraulic motor 10 is formed on a central part of the base portion 65.

As illustrated in FIG. 5, the hydraulic motor 10 is fittedly inserted into the through-hole 64 in a state in which a tip end of a rotational shaft 13 is arranged on a surface side (side on which the fan is installed) of the base portion 65 of the bracket 61 and the rotation sensor 50 is arranged on a rear surface side of the base portion 65 and is fixed to the base portion 65 by a plurality of bolts 71. As illustrated in FIG. 6, a portion located on a rear surface side of a base portion of the hydraulic motor 10, that is to say, a rear end side of a casing 11 and an end cover 12 to be described later are covered with the side wall portion 66 of the bracket 61 on both sides thereof.

The fan 62 is composed of a fan boss 67 and a plurality of blades 68. Each of the blades 68 is fastened to the fan boss 67 by a bolt and the fan boss 67 is fastened to the rotational shaft 13 of the hydraulic motor 10 by a bolt 72, and when driving the hydraulic motor 10, the fan 62 rotates.

The shroud 63 is a square frame-shaped member as seen from front installed so as to enclose the fan 62 in order to improve blast performance of the fan 62, and is attached to the radiator 80 and the bracket 61 using appropriate means. A circular opening 69 is provided on a central part of the shroud 63 as illustrated in FIG. 4.

In the fan driving device 60 having the above-described configuration, the fan 62 rotates when the hydraulic motor 10 is driven, air of which temperature is low sucked by the rotation of the fan 62 passes through the radiator 80, thereby promoting thermal exchange of the radiator 80.

Next, the hydraulic motor 10 that drives the fan 62 is described in detail with reference to FIGS. 1 to 3. The hydraulic motor 10 is provided with the casing 11, the end cover 12, the rotational shaft 13, a cylinder block 14, a piston 15, a valve plate 16 and a swash plate 17.

The casing 11 accommodates the rotational shaft 13, the cylinder block 14, the valve plate 16 and the swash plate 17 inside thereof and is formed into a cylindrical shape composed of a cylindrical portion 21 of which one end is opened and an end wall portion 22. Hereinafter, an end wall portion 22 side and an opening side of the casing 11 are referred to as a "tip end side" and a "rear end side", respectively. As illustrated in FIGS. 1 to 3, a flange-shaped attaching portion 18 protruding radially outward from an end on the opening side is formed on the cylindrical portion 21. A bolt hole (not illustrated) for attaching the hydraulic motor 10 to the bracket 61 of the above-described fan driving device is provided on the attaching portion 18. The attaching portion 18 is allowed to abut a rear surface of the base portion 65 when the hydraulic motor 10 is attached to the base portion 65 of the bracket 61 in the fan driving device and is fastened to the base portion 65 by the bolts 71, as illustrated in FIGS. 5 and 6.

The end cover 12 is a lid body that blocks the opening on the rear end side of the casing 11. A direction switching valve 1 is incorporated in the end cover 12 to switch supply/discharge directions of oil from the hydraulic pump 2 by switching a spool la. An oil seal 23*a* is provided between the end wall portion 22 of the cylindrical portion 21 and the rotational shaft 13 in the casing 11. Also, an oil seal 23*b* is provided between the casing 11 and the end cover 12. The oil is enclosed in the casing 11 by the oil seals 23*a* and 23*b*.

The rotational shaft 13 is rotatably supported by the casing 11 and the end cover 12 through bearings 24*a* and 24*b*, respectively. Meanwhile, in a following description, a side on which the rotational shaft 13 is supported by the bearing 24*a* is referred to as a "base end side" of the rotational shaft and a side on which the rotational shaft 13 is supported by the bearing 24*b* is referred to as a "tip end side" of the rotational shaft. As illustrated in FIG. 1, the tip end of the rotational shaft 13 protrudes outwardly from the end wall portion 22 of the casing 11. The above-described fan boss 67 of the fan 62 is attached to the tip end of the rotational shaft 13.

The cylinder block 14 is coupled to the rotational shaft 13 through a spline 26 to be rotated integrally with the rotational shaft 13 in the casing 11. The cylinder block 14 is arranged such that an end face 27 on a tip end side (hereinafter, referred to as a "tip end face 27") is opposed to the swash plate 17 and an end face 28 on a rear end side (hereinafter, referred to as a "rear end face 28") slidingly contacts a surface of the valve plate 16, and is rotatable while contacting the valve plate 16. A plurality of cylinder holes 29 are provided on the cylinder block 14 at regular intervals in a circumferential direction around an axis of the cylinder block 14 and so as to be parallel to the rotational shaft 13, as illustrated in FIG. 1. A cylinder port 32, which is to be in communication with a supply/discharge port 31 of the valve plate 16 to be described later, is formed on a base end portion of each cylinder hole 29 located on a rear end face 28 side of the cylinder block 14.

The piston 15 is fittedly inserted into each cylinder hole 29 so as to be able to reciprocate. The piston 15 presses the swash plate by supply of the oil into the cylinder hole 29, thereby generating the rotational force in the cylinder block 14 by force of a rotational direction component generated when pressing the swash plate 17. As illustrated in FIG. 1, a tip end of each piston 15 has a structure in which a piston shoe 33 is attached to a concave spherical portion. The piston shoe 33 slides on a sliding surface S of the swash plate 17 so as to be able to slidingly contact the same by means of a shoe retainer 34.

The valve plate 16 is formed into a circular plate shape and is fixed to the end cover 12 so as to slidingly contact the rear end face 28 of the cylinder block 14. The valve plate 16 is provided with elongated hole-shaped supply/discharge ports 31, 31 formed along the circumferential direction as illustrated in FIG. 3. Each supply/discharge port 31 penetrates the valve plate 16 in an axial direction thereof as illustrated in FIG. 1, and an opening thereof on a side to abut the cylinder block 14 may be in communication with a plurality of cylinder ports 32. An opening of each supply/discharge port 31 on a side to abut the end cover 12 is in communication with supply/discharge passages 42, 42 formed within the end cover 12. Meanwhile, the supply/discharge passages 42, 42 formed within the end cover 12 are connected to the hydraulic pump 2 or an oil tank 5 through pipe lines 3, 4 and the direction switching valve 1.

The swash plate 17 is provided between the end wall portion 22 of the casing 11 and the cylinder block 14 and has a flat sliding surface S tilted at a predetermined angle in a plane parallel to the X-Y plane, as illustrated in FIG. 2. As described above, each piston shoe 33 circularly slides while being pressed onto the sliding surface S in association with the rotation of the cylinder block 14. In this embodiment, as illustrated in FIG. 2, a fixed displacement type with the swash plate 17 fixed to the end wall portion 22 is applied. Meanwhile, a variable displacement type provided with a swash plate tilting device that changes a tilt angle of the swash plate 17 may also be applied. In a case of the variable displacement type, motor capacity may be changed by changing the tilt angle of the sliding surface S to change distance of reciprocation of the piston 15.

In the hydraulic motor 10 having the above-described configuration, as illustrated in FIG. 1, the oil from the hydraulic pump 2 is supplied to the cylinder hole 29 through one supply/discharge passage 42 and one supply/discharge port 31, on the other hand, the oil in each cylinder hole 29 is discharged to the supply/discharge passage 42 through the other supply/discharge port 31 to be returned to the oil tank 5. The piston 15 in the cylinder hole 29 to which the oil is supplied presses the swash plate 17. Then, the rotational force is generated by the force of the rotational direction component generated in the piston 15. The rotational force is transmitted to the rotational shaft 13 through the cylinder block 14 to rotate the rotational shaft 13.

Next, the rotation sensor 50 provided in the above-described hydraulic motor 10 and a detected unit 52 detected by the rotation sensor 50 are described in detail.

As illustrated in FIG. 1, a through-hole 25 penetrating in a radial direction is formed on the rear end side of the above-described casing 11 and the rotation sensor 50 is mounted in the through-hole 25. Meanwhile, in the embodiment, a plane perpendicular to the rotational shaft 13 in FIG. 1 and including the attaching portion 18 is considered and the rotation sensor 50 is installed so as to include a part of the plane. The rotation sensor 50 detects a rotational speed of the above-described cylinder block 14 within a predetermined time period. The cylinder block 14 and the rotational shaft 13 integrally rotate and the rotational shaft 13 and the fan 62 integrally rotate. Therefore, the rotational speed of the cylinder block 14 is equal to the rotational speed of the fan 62.

The rotation sensor 50 is provided with a detecting unit 51 that detects the detected unit 52 provided on an outer circumferential surface of the cylinder block 14. The detecting unit 51 is fixed to the casing 11 in a state opposed to the detected unit 52 at a regular interval. A detection result by the detecting unit 51 is transmitted to a calculating unit not illustrated. The calculating unit calculates the rotational speed of the cylinder block 14 based on the detection result by the detecting unit 51.

As the above-described rotation sensor 50, an electromagnetic pick up sensor using an MR element (magnetoresistance effect element) and a Hall element, for example, may be applied. The electromagnetic pick up rotation sensor is a general sensor having a structure obtained by winding a coil around a permanent magnet and detects change in magnetic flux between the detecting unit and the detected unit.

The detected unit 52 is a gear-shaped concavo-convex portion formed by cutting the concave portions 53 at regular intervals across the entire circumference of the outer circumferential surface of the cylinder block 14 as illustrated in FIG. 3. The detected unit 52 is formed on a position corresponding to an arranging position of the above-described rotation sensor 50, that is to say, on the rear end side of the cylinder block 14.

When the cylinder block 14 rotates, the concave portion 53 and a convex portion 54 of the detected unit 52 pass through the position of the rotation sensor 50, thereby periodically changing distance (magnetic field) between the detecting unit 51 and the detected unit 52. The detecting unit 51 of the rotation sensor 50 outputs alternating-current voltage generated by change in the magnetic field as a signal and transmits the signal to the calculating unit. The calculating unit shapes the alternating-current voltage into a pulse and counts a pulse number to calculate the rotational speed of the cylinder block 14 (that is to say, the rotational speed of the fan 62).

The above-described arranging position of the rotation sensor 50 is described in more detail. As illustrated in FIG. 1, in the embodiment, it is configured such that the detecting unit 51 of the rotation sensor 50 is arranged on the rear end side of the casing 11.

Herein, the "rear end side of the casing" is a position opposed to a position between a deepest portion 41 of a portion in which an inner diameter of the cylinder hole 29 is a piston diameter and the rear end face 28 of the cylinder block 14 in an axial direction of the cylinder block 14. A reason to arrange the rotation sensor 50 on the rear end side of the casing 11 is as follows. The base end side and the tip end side of the rotational shaft 13 are supported by the bearings 24*a* and 24*b*, respectively. Therefore, runout of the rotational shaft 13 by whirling is the largest at a central part between the base end side and the tip end side. Therefore, when the detecting unit 51 is provided on the base end side of the rotational shaft 13 as illustrated in FIG. 1, that is to say, on the position opposed to the position between the deepest portion 41 of the cylinder hole 29 and the rear end side end face 28 of the cylinder block 14 in the axial direction of the cylinder block 14, this is less affected by the runout of the rotational shaft 13 as compared to a case in which this is provided so as to be closer to the tip end side than the position illustrated in FIG. 1. That is to say, the distance between the detected unit 52 formed on the outer circumferential surface of the cylinder block 14 and the detecting unit 51 of the rotation sensor 50 is always maintained substantially constant regardless of the whirling of the cylinder block 14.

Also, as described above, the hydraulic motor 10 rotates the cylinder block 14 by changing a position of the piston 15 that slides in the cylinder holes 29 arranged on the same circle with time. Therefore, the whirling of the cylinder block 14 is generated in a direction of a maximum tilt angle of the swash plate 17, that is to say, in the X-Y plane illustrated in FIG. 2. Therefore, in this embodiment, the detecting unit 51 of the rotation sensor 50 is arranged in the X-Z plane illustrated in FIG. 1.

Herein, the "X-Z plane" is the plane including both of a line on the sliding surface S of the swash plate 17 orthogonal to an axis 13*a* of the rotational shaft 13 and the axis 13*a*. That is to say, the "line on the sliding surface S of the swash plate 17 orthogonal to the axis 13*a*" is the line orthogonal to a line in the direction of the maximum tilt angle of the swash plate 17. In other words, the "plane including both of the line on the sliding surface S of the swash plate 17 orthogonal to the axis 13*a* and the axis 13*a*" is the plane orthogonal to the plane including both of the line in the direction of the tilt angle on the sliding surface S of the swash plate 17 and the axis 13*a* (X-Y plane in FIG. 2).

When the rotation sensor 50 is arranged in the X-Z plane orthogonal to the X-Y plane, the effect of vibration in the X-Y direction of the cylinder block 14 may be minimized. Meanwhile, the "plane including both of the line on the sliding surface of the swash plate orthogonal to the axis of the rotational shaft and the axis" includes a plane obtained by rotating the X-Z plane illustrated in FIG. 1 a few degrees around the axis of the rotational shaft 13.

Meanwhile, when applying the variable displacement type in which the tilt angle of the swash plate 17 may be changed, the above-described X-Z plane means the plane including both of an axis of a swash plate rotating shaft for tilting the swash plate 17 (not illustrated) and the axis 13*a* of the rotational shaft 13.

In response to the arrangement of the detecting unit 51 of the rotation sensor 50 on the rear end side of the casing, the detected unit 52 is formed between the deepest portion 41 of the portion in which the inner diameter of the cylinder hole 29 is the piston diameter and the rear end side end face 28 of the cylinder block 14 in the axial direction of the cylinder block 14. As illustrated in FIG. 1, dimension in a Z-direction of the cylinder port 32 is smaller than diameter dimension of the cylinder hole 29, so that an outer circumferential portion of a forming position of the cylinder port 32 is thicker than an outer circumferential portion of a forming position of the cylinder hole 29. When forming the detected unit 52 by utilizing the thick portion, there is a following advantage.

As illustrated in FIG. 1, the outer circumferential portion of the forming position of the cylinder hole 29 is thin. Therefore, when the detected unit 52 is formed so as to be closer to the tip end side of the cylinder block than the position illustrated in FIG. 1, it is necessary to form the concave portion 53 between adjacent cylinder holes so as to avoid the thin portion in order to secure strength. In this case, the number of the concave portions 53 to be formed is the same as the number of the cylinder holes 29. On the other hand, when the detected unit 52 is provided on the above-described thick portion, it is possible to continuously form the concavo-convex portion in the gear-shape, so that a cutting process is easy and the concave portions 53 may be formed regardless of the number of the cylinder holes 29.

Also, when the fan driving device 60 illustrated in FIGS. 4 to 6 is driven, since the fan 62 having a large shape rotates at a tip end of the hydraulic motor 10, the tip end of the hydraulic motor 10 most easily vibrates. On the other hand, since the base portion 65 is fixed, the vibration is small in the vicinity of the base portion 65, and the farther it is from the base portion 65, the larger the vibration is. Therefore, when attaching the hydraulic motor 10 to the base portion 65, in order to minimize the vibration transmitted to the rotation sensor 50 when driving the hydraulic motor, it is preferable that the rotation sensor 50 is arranged so as to be closer to the base portion 65 as far as possible. As described above, the hydraulic motor 10 is attached to the base portion 65 by fittedly inserting the casing 11 into the through-hole 64 of the base portion 65 and allowing the attaching portion 18 to abut the rear surface of the base portion 65 to be fixed by the bolt. Also, as described above, the rotation sensor 50 is installed in the casing 11 so as to include a part of the plane perpendicular to the rotational shaft 13 and including the attaching portion 18. Therefore, when the hydraulic motor 10 is attached to the base portion 65, the rotation sensor 50 is arranged on the position close to the rear surface of the base portion 65. Therefore, the vibration transmitted to the rotation sensor 50 when driving the hydraulic motor may be minimized.

Meanwhile, when the fan driving device 60 is driven, dust and mud are sucked with air from outside. The dust and mud pass through the radiator 80, the fan 62 and the opening 69 of the shroud 63. However, as illustrated in FIG. 6, the rear end side of the hydraulic motor 10 is located on the rear surface side of the base portion 65 of the bracket 61 and both sides thereof are covered with the side wall portion 66. Therefore, the rotation sensor 50 is protected from the dust and mud sucked from the outside.

As described above, the fan driving device 60 of the embodiment has a configuration in which the detected unit 52 is provided on the outer circumferential surface of the cylinder block 14 in the hydraulic motor 10 that drives the fan 62 and the rotation sensor 50 that detects the detected unit 52 is provided on the position corresponding to the position between the deepest portion 41 of the cylinder hole 29 and the cylinder block rear end face 28 in the axial direction of the cylinder block 14. With the above-described configuration, the distance between the rotation sensor 50 and the detected unit 52 may be maintained substantially constant regardless of the whirling of the cylinder block 14. As a result, detection accuracy of the rotational speed of the cylinder block may be improved as compared to the conventional one, and it becomes possible perform the fan control with high accuracy.

Also, the fan driving device 60 of the embodiment has a configuration in which the detecting unit 51 of the rotation sensor 50 is arranged in the plane including both of the line on the swash plate 17 orthogonal to the axis 13*a* of the rotational shaft 13 of the hydraulic motor 10 and the axis 13*a*. With the above-described configuration, this is less affected by the whirling of the cylinder block 14 in the X-Y plane. As a result, the detection accuracy of the rotational speed of the cylinder block may be further improved.

Also, according to the fan driving device 60 of the embodiment, since the above-described detected unit 52 is formed to be the thick portion between the deepest portion 41 of the portion in which the inner diameter of the cylinder hole 29 is the piston diameter and the rear end side end face 28 of the cylinder block 14 in the axial direction of the cylinder block 14, the cut process may be performed easily. Also, it is possible to increase the number of the concave portions 53 to be formed regardless of the number of the cylinder holes 29, so that the detection accuracy of the rotational speed of the cylinder block 14 may be further improved.

Further, according to the fan driving device 60 of the embodiment, since it is configured such that the hydraulic motor 10 is attached to the bracket 61 in a state in which the above-described rotation sensor 50 is brought closer to the rear surface of the base portion 65, the vibration transmitted to the rotation sensor 50 when driving the hydraulic motor may be minimized, so that possibility of breakdown by the vibration of the rotation sensor may be made smaller.

In addition, according to the fan driving device 60 of the embodiment, it is configured such that the hydraulic motor 10 is attached to the bracket 61 in a state in which the above-described rotation sensor 50 is located on the rear surface side of the bracket 61, so that it is possible to prevent the dust and mud entering from the outside from attaching to the rotation sensor 50.

Meanwhile, although the case in which the hydraulic pump/motor of the invention is applied to the fan driving device is described in the above-described embodiment, the invention is not limited thereto, and may be applied to another driving device or swash plate hydraulic pump.

The invention claimed is:

1. A hydraulic pump/motor, comprising:

a rotational shaft, both of whose ends are rotatably attached to a casing and an end cover closing an opening of the casing via a bearing;

a cylinder block rotating together with the rotational shaft;

a plurality of pistons fittedly inserted into a plurality of cylinder holes formed on the cylinder block so as to be able to reciprocate;

a swash plate provided in the casing so as to be tilted relative to the rotational shaft to allow tip ends of the pistons to slide so as to be able to slidingly contact the swash plate;

a valve plate that slidingly contacting a rear end face of the cylinder block, wherein the hydraulic pump/motor distributes oil into the cylinder holes through a port provided on the valve plate;

a detected unit formed on an outer circumferential surface of the cylinder block; and a rotation sensor arranged in the casing in a state opposed to the detected unit for detecting the detected unit, wherein the rotation sensor is provided on a position corresponding to a position between a deepest portion of the cylinder hole and the rear end face of the cylinder block in an axial direction of the cylinder block.

2. The hydraulic pump/motor according to claim 1, wherein the rotation sensor is arranged in a plane including a line on a sliding surface of the swash plate orthogonal to an axis of the rotational shaft and the axis.

3. A fan driving device, comprising:

a hydraulic motor including a rotational shaft, both of whose ends are rotatably attached to a casing and an end cover closing an opening of the casing via a. bearing in a casing in a state in which a tip end of the rotational shaft protrudes from the casing, a cylinder block rotating together with the rotational shaft, a plurality of pistons fittedly inserted into a plurality of cylinder holes formed on the cylinder block so as to be able to reciprocate, a swash plate provided in the casing so as to be tilted relative to the rotational shaft to allow tip ends of the pistons to slide so as to be able to slidingly contact the swash plate, and a valve plate slidingly contacting a rear end face of the cylinder block, the hydraulic motor for distributing oil in the cylinder holes through a port provided on the valve plate;

a bracket provided with a planar base portion having a through-hole to which the hydraulic motor is attached in a state in which a tip end of the rotational shaft is arranged on a surface side of the base portion by fittedly inserting the casing into the through-hole; and a fan attached to the tip end of the rotational shaft and is driven by the hydraulic motor, wherein the hydraulic motor includes a plurality of detected units provided on an outer circumferential surface of the cylinder block, and a rotation sensor arranged in the casing in a state opposed to a portion between a deepest portion of the cylinder hole and the rear end face of the cylinder block in an axial direction of the cylinder block for detecting the detected units, and the fan driving device attached to the bracket in a state in which the rotation sensor is located on a rear surface side of the base portion.

4. The fan driving device according to claim 3, wherein the hydraulic motor is attached to the bracket in a state in which the rotation sensor is brought closer to a rear surface of the base portion.

5. The fan driving device according to claim 3, wherein the rotation sensor is arranged in a plane including a line on a sliding surface of the swash plate orthogonal to an axis of the rotational shaft and the axis.

* * * * *